US009988901B2

(12) United States Patent
Rowe

(10) Patent No.: US 9,988,901 B2
(45) Date of Patent: Jun. 5, 2018

(54) METHODS FOR DETERMINING GAS EXTRACTION EFFICIENCY FROM A DRILLING FLUID

(71) Applicant: Halliburton Energy Services, Inc., Houston, TX (US)

(72) Inventor: Mathew Dennis Rowe, Lafayette, LA (US)

(73) Assignee: Halliburton Energy Services, Inc., Houston, TX (US)

( * ) Notice: Subject to any disclaimer, the term of this patent is extended or adjusted under 35 U.S.C. 154(b) by 131 days.

(21) Appl. No.: 14/898,603

(22) PCT Filed: Jun. 29, 2015

(86) PCT No.: PCT/US2015/038253

§ 371 (c)(1),
(2) Date: Dec. 15, 2015

(87) PCT Pub. No.: WO2017/003419

PCT Pub. Date: Jan. 5, 2017

(65) Prior Publication Data

US 2017/0167257 A1 Jun. 15, 2017

(51) Int. Cl.
*E21B 49/08* (2006.01)
*E21B 21/06* (2006.01)

(52) U.S. Cl.
CPC ..... *E21B 49/088* (2013.01); *E21B 21/067* (2013.01); *E21B 49/086* (2013.01)

(58) Field of Classification Search
CPC .... E21B 49/088; E21B 21/067; E21B 49/086; E21B 49/003
See application file for complete search history.

(56) References Cited

U.S. PATENT DOCUMENTS 7,232,548 B2 6/2007 Duriez et al.
8,616,051 B2 * 12/2013 Kimour ..... B01D 53/0423 73/152.04

(Continued)

FOREIGN PATENT DOCUMENTS

EP 0555965 A2 8/1993
WO 2014033265 A1 3/2014
WO WO-2014137356 A1 * 9/2014 ..... E21B 47/1015

OTHER PUBLICATIONS

International Search Report and Written Opinion for PCT/US2015/038253 dated Nov. 18, 2015.

*Primary Examiner* — Michael R Wills, III
(74) *Attorney, Agent, or Firm* — McDermott Will & Emery LLP

(57) ABSTRACT

It can sometimes be difficult to determine accurately the in-process degassing efficiency of a drilling fluid, thereby leading to inaccurate feedback from an ongoing drilling operation. Methods for determining degassing efficiency of a drilling fluid can comprise: combining a measured amount of an analysis gas with a drilling fluid sample; transferring the drilling fluid sample and the analysis gas to a degassing unit; withdrawing at least a portion of the analysis gas from the drilling fluid sample in the degassing unit; conveying the withdrawn analysis gas from the degassing unit to a detector with an inert carrier gas; determining an amount of the withdrawn analysis gas with the detector; and calculating an extraction efficiency of the analysis gas from the drilling fluid sample based upon the amount of the withdrawn analysis gas. The extraction efficiency may provide an estimate of the degassing extent for other gases.

15 Claims, 3 Drawing Sheets

(56) References Cited

U.S. PATENT DOCUMENTS

| | | | | |
|---|---|---|---|---|
| 2011/0303463 | A1 | 12/2011 | Lessi | |
| 2012/0234599 | A1 | 9/2012 | Brumboiu | |
| 2013/0263647 | A1 | 10/2013 | Barrett et al. | |
| 2014/0067307 | A1* | 3/2014 | Guerriero | G01N 33/2823 702/100 |
| 2015/0361792 | A1* | 12/2015 | Rowe | E21B 47/1015 702/13 |
| 2016/0273353 | A1* | 9/2016 | Rowe | E21B 47/10 |

* cited by examiner

METHODS FOR DETERMINING GAS EXTRACTION EFFICIENCY FROM A DRILLING FLUID

BACKGROUND

The present disclosure generally relates to drilling fluids and, more specifically, to methods for determining the efficiency of gas extraction from a drilling fluid.

Treatment fluids may be used in a variety of subterranean treatment operations. Such treatment operations can include, without limitation, drilling operations, stimulation operations, production operations, remediation operations, and the like. As used herein, the terms "treat," "treatment," "treating," and grammatical equivalents thereof refer to any subterranean operation that uses a fluid in conjunction with achieving a desired function and/or for a desired purpose. Use of these terms does not imply any particular action by the treatment fluid or a component thereof, unless otherwise specified herein. More specific examples of illustrative treatment fluids can include, for example, drilling fluids, fracturing fluids, gravel packing fluids, acidizing fluids, conformance fluids, scale dissolution and removal fluids, diverting fluids, and the like.

A drilling fluid or drilling mud is a designed fluid intended for circulation through a wellbore to facilitate a drilling operation. Functions of a drilling fluid can include, without limitation, removing drill cuttings from the wellbore, cooling and lubricating the drill bit, aiding in the support of the drill pipe and the drill bit, and forming a hydrostatic head to maintain integrity of the wellbore walls and/or to prevent blowouts from occurring. Drilling fluids may be water-based or oil-based and may sometimes be in the form of an emulsion.

Drilling fluids can also be analyzed to detect and/or quantify gaseous compounds being expelled from a wellbore in the course of a drilling operation. This information can be very valuable for a well operator. For example, analysis of gaseous wellbore compounds and their sequence of removal from a wellbore can help a well operator determine the geological profile of a subterranean formation penetrated by the wellbore. Although simply detecting the presence of particular gaseous compounds can sometimes provide sufficient information to a well operator, it can often be desirable to quantify the amount of gaseous compounds that are present in a drilling fluid sample.

It is frequently desirable to analyze for gaseous compounds following their removal from the drilling fluid. Removal of the gaseous compounds from the drilling fluid can take place through various degassing techniques, which may have varying degrees of extraction efficiency. As used herein, the term "extraction efficiency" will refer to the fraction of a gaseous compound withdrawn from a drilling fluid compared to the amount of the gaseous compound originally present in the drilling fluid. Degassing can often be incomplete, and the actual extent of degassing can be difficult to determine accurately. Incomplete degassing of a drilling fluid can therefore lead to an inaccurate determination of the amount of gaseous compounds actually present therein, which can subsequently lead to an incorrect analysis of the geological profile being encountered downhole. The consequences of inadequately determining the quantity of gaseous compounds that are present in a drilling fluid can range from costly inefficiency in the drilling process to extreme safety issues. For example, an incoming flux of hydrocarbon gas or hydrogen sulfide can help a well operator determine whether a drilling operation has gone as intended. Specifically, the identity and amount of a withdrawn wellbore gas can help a well operator determine if a geological stratum of interest has been reached during drilling.

Presently, there are limited ways to determine the absolute degassing efficiency of a drilling fluid, particularly for analyses conducted in-process. Many conventional degassing techniques subject a drilling fluid to multiple degassing cycles in sequence, and as the amount of withdrawn gaseous compounds drops below a threshold value, the degassing operation is presumed to be complete. However, significant quantities of gaseous compounds may still remain in the drilling fluid even after multiple degassing cycles have been completed, and the detected quantity of gaseous compounds may not be representative at all of the "true" quantity of gaseous compounds that are present. Moreover, from an operational standpoint, multiple degassing cycles can represent an inefficient use of a well operator's time and resources.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, as will occur to one having ordinary skill in the art and the benefit of this disclosure.

DETAILED DESCRIPTION

Figure 1:
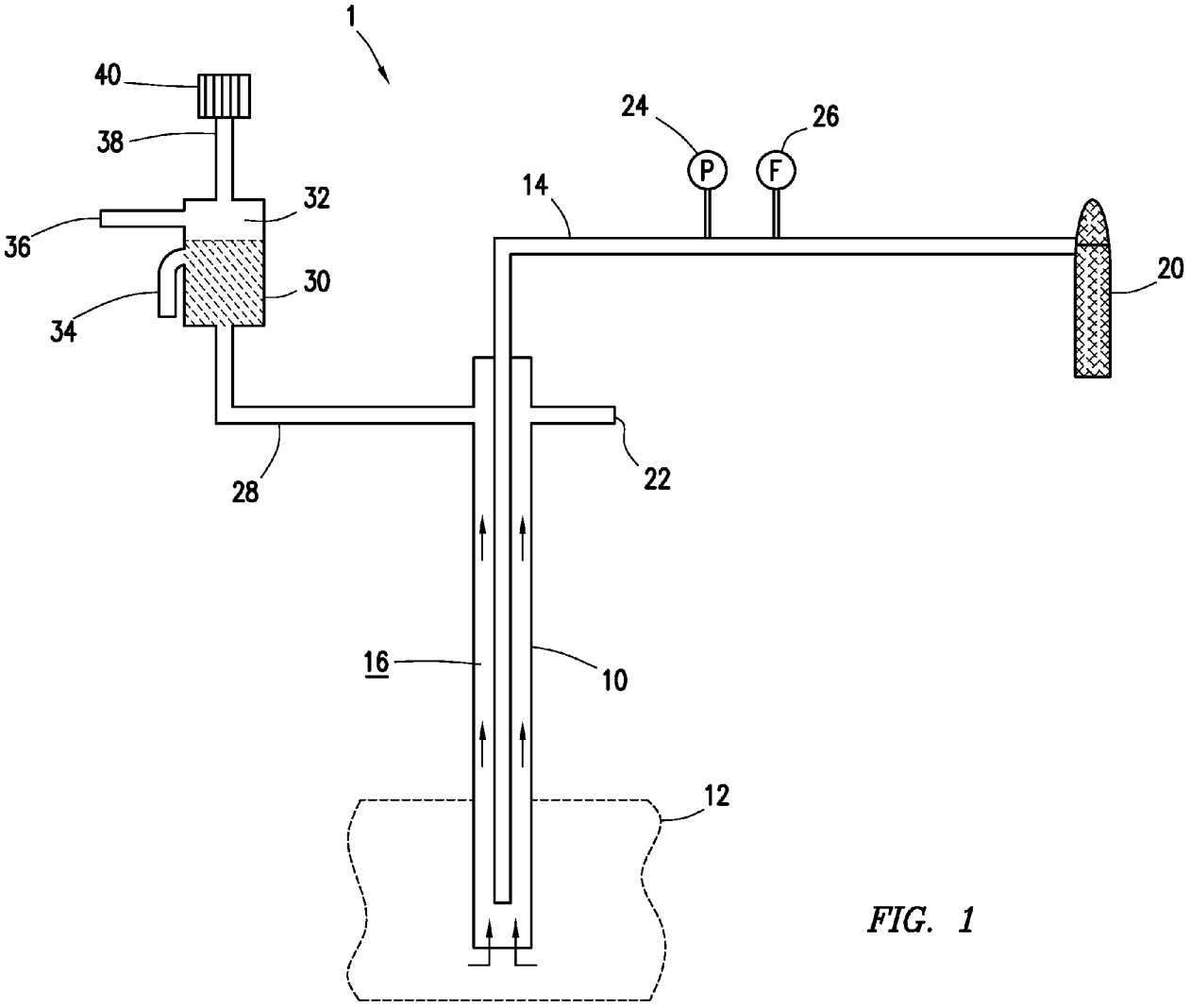
FIG. 1 shows a schematic of an illustrative system in which a measured amount of an analysis gas can be introduced to a drilling fluid sample being withdrawn from a wellbore.

The present disclosure generally relates to drilling fluids and, more specifically, to methods for determining the efficiency of gas extraction from a drilling fluid.

One or more illustrative embodiments incorporating the features of the present disclosure are presented herein. Not all features of a physical implementation are necessarily described or shown in this application for the sake of clarity. It is to be understood that in the development of a physical implementation incorporating the embodiments of the present disclosure, numerous implementation-specific decisions may be made to achieve the developer's goals, such as compliance with system-related, business-related, government-related and other constraints, which may vary by implementation and from time to time. While a developer's efforts might be time-consuming, such efforts would be, nevertheless, a routine undertaking for one having ordinary skill in the art and the benefit of this disclosure.

As discussed above, it can be problematic to determine how efficiently a drilling fluid has been degassed following the drilling fluid's removal from a wellbore. This issue, in turn, can make it difficult to determine the "true" quantity of gaseous compounds carried from the wellbore within the drilling fluid. Incomplete degassing and inaccurate analyses resulting therefrom can detrimentally impact the success and safety of a drilling operation. Even having a general recognition that incomplete degassing has occurred, it can still be problematic to determine the extraction efficiency with a sufficient degree of accuracy to establish a correlation with the "true" quantity of gaseous compounds that are carried within the drilling fluid.

Although various techniques have been developed for degassing drilling fluids in the course of analyzing for gaseous substances, these techniques are not believed to provide an absolute measure of the extraction efficiency. In order to address the issues presented by indeterminate extraction of gaseous substances from drilling fluids, the present inventor developed facile techniques to introduce a measured quantity of an analysis gas to a drilling fluid sample and then determine how efficiently the analysis gas is subsequently withdrawn therefrom in a degassing unit. Upon feeding the withdrawn analysis gas to a detector, the extraction efficiency can then be calculated from the analysis gas quantity analyzed at the detector divided by the total quantity of analysis gas introduced to the drilling fluid sample. An extraction efficiency of zero represents no analysis gas extraction, and an extraction efficiency of one indicates complete extraction. Once a value for the extraction efficiency of the analysis gas has been determined under a particular set of degassing conditions, the extraction efficiency can then be used to calculate the concentration value of other gaseous substances in the drilling fluid. Specifically, the extraction efficiency may be used to estimate the concentration of other gaseous substances within the drilling fluid based upon the amount of the gaseous substances withdrawn and detected following degassing.

More specifically, the present inventor discovered that a standard "bump test" may be modified in order to analyze a drilling fluid and realize the foregoing advantages. As one of ordinary skill in the art will recognize, a "bump test" is a performance check conducted upon a qualitative detector in order to verify that the detector is producing a positive response. Bump tests are periodically performed by intentionally exposing the detector to an analyte for which the detector is sensitive. Standard bump tests are not configured to quantify detector performance, since the test's goal is simply to verify that a detector is functioning as intended.

The present inventor recognized that conventional oilfield equipment for sampling and degassing a drilling fluid may be modified to determine extraction efficiency in a quantitative manner. Specifically, the inventor first recognized that conventional oilfield sampling and degassing equipment may be readily coupled to an analysis gas source. Introducing an analysis gas from the analysis gas source can allow a bump test to be performed. Details of how the inventor chose to couple the analysis gas source to the existing oilfield equipment are discussed in more detail hereinbelow.

Extending the initial discovery further, the present inventor also determined that by introducing a measured amount of the analysis gas to a drilling fluid sample, the extraction efficiency may then be determined. Further details of how the extraction efficiency of the analysis gas may be determined are also discussed hereinbelow.

Once the extraction efficiency of the analysis gas is known, the extraction efficiency may then be used to estimate the amounts of other gaseous substances that are present in the drilling fluid. Specifically, if one assumes that other gaseous substances are withdrawn with equal efficacy from the drilling fluid under a particular set of degassing conditions, the detected amount of the other gaseous substances may be correlated using the extraction efficiency to the actual amount of gaseous substances present in the drilling fluid. The profile of gaseous substances in the drilling fluid may provide a number of pieces of useful information including, for example, the amount of hydrocarbon fluids in a subterranean formation and/or a gas-oil ratio. Extension of the gaseous substance profile of a drilling fluid to determine the content of a subterranean reservoir is considered to be beyond the scope of this disclosure and will not be addressed further herein.

FIG. 1 shows a schematic of an illustrative system in which a measured amount of an analysis gas can be introduced to a drilling fluid sample being withdrawn from a wellbore. As shown in FIG. 1, system 1 includes suction tube 10, one terminus of which is immersed in a drilling fluid in conduit 12. Conduit 12 is in fluid communication with a wellbore and carries a drilling fluid therein. Gas line 14 enters through the other terminus of suction tube 10 and extends within its interior space, thereby defining annulus 16. Analysis gas source 20 supplies an analysis gas to a drilling fluid sample through gas line 14. The analysis gas is combined with the drilling fluid sample in the lower terminus of suction tube 10. Optionally, blowback line 22 may be coupled to suction tube 10 in order to clear blockages that occur within annulus 16 upon introduction of the drilling fluid and drill cuttings, for example. Vibrational means may also be present in order to keep suction tube 10 free of blockages.

In order to determine the amount of analysis gas introduced to the drilling fluid sample, pressure gauge 24 and flow meter 26 are coupled to gas line 14. Pressure gauge 24 and flow meter 26 may be located at any arbitrary position along gas line 14, and the depicted location should not be considered as limiting. By reading the pressure and volume of the analysis gas from pressure gauge 24 and flow meter 26, respectively, as well as by knowing or determining the surrounding temperature (e.g., with a thermometer or thermocouple), the number of moles of the analysis gas passing through gas line 14 into suction tube 10 may be determined. For example, the number of moles of analysis gas may be determined using the ideal gas law (Formula 1) or a variation thereof (Formula 2), where n is the number of moles of analysis gas, P is the analysis gas pressure, V is the analysis gas volume determined from flow meter 26, T is the surrounding temperature, R is the ideal gas constant (8.314 J/mol·K), and Z is a correction factor to account for non-ideal gas behavior. Formula 2 is sometimes referred to as the "true gas law" or "non-ideal gas law." Other formulas for relating the various parameters of the analysis gas to one another may also be employed.

$$n = PV/RT \qquad \text{Formula 1}$$

$$n = PV/ZRT \qquad \text{Formula 2}$$

Continuing with reference to FIG. 1, a drilling fluid sample is withdrawn from conduit 12 and enters suction tube 10. The analysis gas from gas line 14 is then combined with the drilling fluid sample. The positioning of gas line 14 within suction tube 10 is largely arbitrary, and the analysis gas may be combined with the drilling fluid at any location within suction tube 10. The drilling fluid sample and the entirety of the analysis gas then pass upwardly through annulus 16 and enter degassing unit 30 via line 28. Within degassing unit 30, the analysis gas is at least partially withdrawn from the drilling fluid sample by a suitable degassing process, and the withdrawn analysis gas enters headspace 32. The degassed drilling fluid exits degassing unit 30 by drain 34. In order to promote further conveyance of the withdrawn analysis gas, an inert carrier gas is added to headspace 32 via line 36. The withdrawn analysis gas and the inert carrier gas are then conveyed by line 38 to detector 40, where the concentration of the analysis gas within the inert carrier gas is determined. If the amount of carrier gas added to the analysis gas is known, the amount of withdrawn analysis gas can then be determined from its measured concentration at detector 40. For example, the amount of added inert carrier gas may be determined before analyzing the drilling fluid sample by measuring the pressure, volume and temperature (e.g., by using pressure gauges, flow meters, thermocouples and like equipment) of the inert carrier gas when system 1 is otherwise free of drilling fluid, and then applying Formula 1 to determine the amount of withdrawn analysis gas. The extraction efficiency of the analysis gas can then be determined by dividing the quantity of withdrawn analysis gas by the total amount of analysis gas combined with the drilling fluid sample.

Further details regarding how the extraction efficiency of an analysis gas may be determined are discussed hereinafter. Although certain details may be described in reference to FIG. 1, it is to be recognized that system 1 is merely an illustrative example of equipment that may be used to practice the embodiments of the present disclosure. Other equipment may be used to accomplish a substantially similar result.

In various embodiments, methods described herein can comprise: combining a measured amount of an analysis gas with a drilling fluid sample; transferring the drilling fluid sample and the analysis gas contained therein to a degassing unit; withdrawing at least a portion of the analysis gas from the drilling fluid sample in the degassing unit; conveying the withdrawn analysis gas from the degassing unit to a detector using an inert carrier gas; determining an amount of the withdrawn analysis gas with the detector; and calculating an extraction efficiency of the analysis gas from the drilling fluid sample based upon the amount of the withdrawn analysis gas. In some embodiments, the analysis gas may be withdrawn from the drilling fluid at a sub-atmospheric pressure. These exemplary operations are described in further detail below.

In the various embodiments of the present disclosure, an analysis gas may be combined with a drilling fluid sample and then undergo subsequent detection and quantification following its removal from the drilling fluid. In some embodiments, the analysis gas may be a gaseous substance that is not present in a subterranean formation from which the drilling fluid is received or obtained. In more particular embodiments, the analysis gas may comprise a flammable gas, such as a hydrocarbon gas, that is not commonly or natively present downhole in a wellbore. By virtue of being a gaseous substance that is not commonly present downhole, the analysis gas may be readily detected in the presence of other common downhole gaseous compounds, such as C1-C4 hydrocarbons, for example. In more particular embodiments, the analysis gas may comprise acetylene.

Regardless of its identity, the behavior of the analysis gas under the particular conditions in the degassing unit may be used to estimate the extraction efficiency of a wellbore gas that may be removed from a wellbore via the drilling fluid during a drilling operation. The extraction efficiency of the wellbore gas, in turn, may be used to determine the amount of wellbore gas that is actually present in the drilling fluid based upon the amount of the wellbore gas measured at the detector. As discussed above, by having an accurate estimate of the amount of wellbore gases present in the drilling fluid, a better understanding of a subterranean formation's geological profile may be ascertained. For example, the extraction efficiency of the analysis gas (e.g., acetylene) may be used to estimate the amount of C1-C4 hydrocarbons present in the drilling fluid based upon the amount of C1-C4 hydrocarbons measured at the detector. Further details in this regard follow below.

The identity and properties of the analysis gas may further determine the type of detector used for assaying the analysis gas following its withdrawal from the drilling fluid sample. For flammable compounds, particularly organic compounds, a flame ionization detector may be desirable. Other illustrative detectors that may be suitable for assaying an analysis gas include photoionization detectors and thermal conductivity detectors, for example. Mass spectrometry may also comprise a suitable detection technique in some embodiments.

The measured amount of the analysis gas that is combined with the drilling fluid sample is not considered to be particularly limited, the only requirements being that the quantity of the analysis gas is known with a desired degree of precision and that the amount of analysis gas is within a detection limit of the detector. As indicated above, by measuring the pressure, volume and temperature of the analysis gas, the molar amount present may be determined by applying Formula 1 or Formula 2. In practicing the methods described herein, it is presumed that the analysis gas is combined quantitatively with the drilling fluid sample, and the entirety of the analysis gas is conveyed in the drilling fluid sample to the degassing unit. In the exemplary system of FIG. 1, it is believed that the influx of drilling fluid into the suction tube is sufficient to resist the analysis gas from flowing outwardly therefrom, thereby ensuring that the entirety of the analysis gas travels to the degassing unit.

Upon the drilling fluid reaching the degassing unit, at least a portion of the analysis gas is withdrawn therefrom and enters the headspace in the degassing unit above the drilling fluid. In order to promote removal of the analysis gas from the drilling fluid, a sub-atmospheric pressure may be applied to the drilling fluid in the degassing unit. Suitable sub-atmospheric pressures may be as low as 0.95 atmospheres, for example. The degassing unit may also provide for mechanical agitation of the drilling fluid in order to promote effective withdrawal of the analysis gas therefrom. Suitable mechanisms for agitating the drilling fluid sample in the degassing unit may include, for example, mechanical stirring (e.g., with an impeller), vibration, rotation, or the like.

Drilling fluid from which the analysis gas has been withdrawn subsequently exits the degassing unit through a drain. In some embodiments, influx and efflux of drilling fluid and analysis gas to and from the degassing unit may occur continuously. In other embodiments, influx and efflux of the drilling fluid and analysis gas to and from the degassing unit may take place portionwise. In portionwise embodiments, the total amount of analysis gas withdrawn from the drilling fluid represents the sum of that removed from each of the portions of the drilling fluid sample.

In order to convey of the analysis gas from the degassing unit to the detector, an inert carrier gas is introduced to the headspace of the degassing unit. Suitable inert carrier gases may include, for example, nitrogen, helium, argon or the like. The amount and flow rate of the inert carrier gas may be chosen to sufficiently promote conveyance of the analysis gas to the detector.

In additional embodiments, methods described herein may further comprise determining an amount of the inert carrier gas used to convey the withdrawn analysis gas to the detector (e.g., at the headspace of the degassing unit). Determining the inert carrier gas amount may comprise measuring the pressure, volume and temperature of the inert carrier gas being supplied to the degassing unit. In some embodiments, these parameters may be determined during the degassing operation. In other embodiments, the amount of the carrier gas may be determined when the system is otherwise free of drilling fluid. Specifically, the inert carrier gas flow rates may be determined when calibrating the system and may deliver the inert carrier gas to the degassing unit under similar conditions when the drilling fluid is present.

In still further embodiments, the methods of the present disclosure may further comprise determining the amount of the withdrawn analysis gas based upon the amount of the inert carrier gas and the concentration of the analysis gas measured at the detector. Specifically, by multiplying the measured concentration of the analysis gas by the volume of the inert carrier gas, the amount of analysis gas admixed with the inert carrier gas may be determined.

In some embodiments, a drilling fluid sample may be analyzed according to the methods of the present disclosure in order to determine the extraction efficiency of an analysis gas before the drilling fluid is used in a drilling operation. That is, the methods of the present disclosure may be used to determine the extraction efficiency before the drilling fluid is placed downhole.

In other various embodiments, methods of the present disclosure may comprise obtaining the drilling fluid sample from a wellbore before combining the analysis gas therewith. That is, in such embodiments, the extraction efficiency of the analysis gas from the drilling fluid sample may be determined in-process during a drilling operation. By determining the extraction efficiency, the amount of a wellbore gas removed from a subterranean formation in the drilling fluid may be determined. The amount of wellbore gas removed from the subterranean formation may be used to provide additional information about the drilling operation, as discussed above.

In more specific embodiments, methods of the present disclosure may comprise: drilling a wellbore with a drilling fluid; obtaining the drilling fluid sample from the wellbore; analyzing a quantity of drilling fluid exiting the wellbore for a wellbore gas; and correlating the extraction efficiency of the analysis gas to a concentration of the wellbore gas in the drilling fluid exiting the wellbore.

Accordingly, in more specific embodiments, methods of the present disclosure may comprise: obtaining a drilling fluid sample from a wellbore; combining a measured amount of an analysis gas with the drilling fluid sample; transferring the drilling fluid sample and the analysis gas contained therein to a degassing unit; withdrawing at least a portion of the analysis gas from the drilling fluid sample in the degassing unit; conveying the withdrawn analysis gas from the degassing unit to a detector, the withdrawn analysis gas being conveyed with an inert carrier gas; determining a concentration of the analysis gas with the detector; determining an amount of the inert carrier gas used to convey the withdrawn analysis gas to the detector; determining an amount of the withdrawn analysis gas based upon the amount of the inert carrier gas and the concentration of the analysis gas measured at the detector; calculating an extraction efficiency of the analysis gas from the drilling fluid sample based upon the amount of the withdrawn analysis gas; and correlating the extraction efficiency of the analysis gas to a concentration of a wellbore gas in the drilling fluid.

Figure 2:
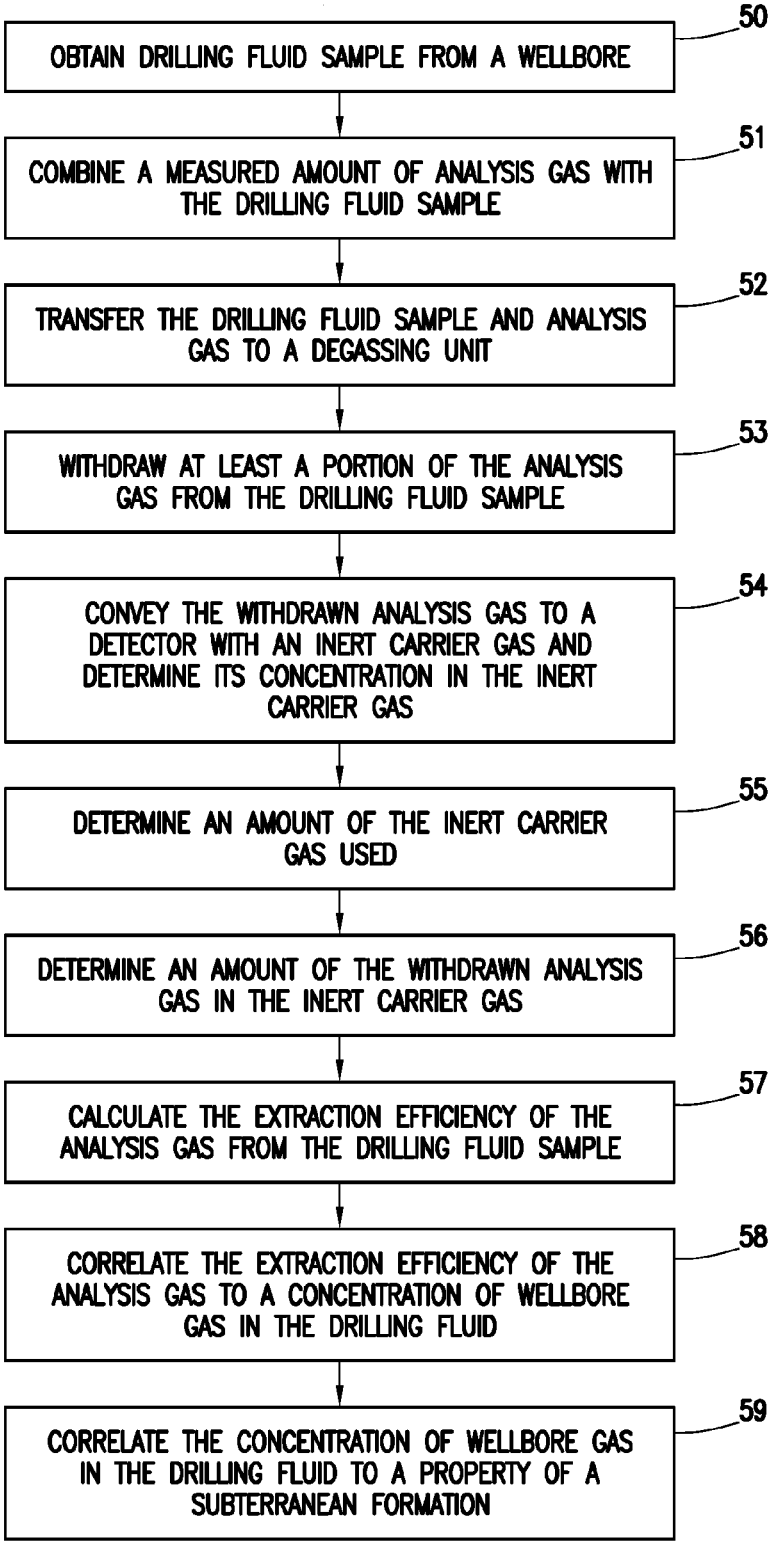
FIG. 2 shows a flow chart illustrating how the extraction efficiency of an analysis gas from a drilling fluid may be determined and further utilized.

The methods described hereinabove will now be described in greater detail with reference to FIG. 2. FIG. 2 shows a flow chart illustrating how the extraction efficiency of an analysis gas from a drilling fluid may be determined and further utilized.

Referring to FIG. 2, a drilling fluid sample is obtained from a wellbore in operation 50. Thereafter, a measured amount of an analysis gas is combined with the drilling fluid sample during operation 51. The measured amount of the analysis gas may be calculated by determining the pressure, volume and temperature of the analysis gas and applying a suitable gas equation, such as Formula 1 or Formula 2 above. The combined drilling fluid sample and analysis gas are then transferred to a degassing unit in operation 52.

In the degassing unit, degassing conditions are applied to the drilling fluid sample in operation 53 to withdraw at least a portion of the analysis gas from the drilling fluid sample. The degassing conditions may include a sub-atmospheric pressure in some embodiments. The withdrawn analysis gas is then conveyed to a detector with an inert carrier gas in operation 54. Upon being analyzed at the detector, a concentration of the analysis gas in the inert carrier gas can be determined.

In order to determine the amount of the withdrawn analysis gas that is present, the amount of the inert carrier gas is determined in operation 55. In operation 56, the amount of withdrawn analysis gas may be determined by multiplying the amount of the inert carrier gas with the concentration of the withdrawn analysis gas measured at the detector. If one assumes that the balance of the analysis gas remains in the drilling fluid sample, the extraction efficiency of the analysis gas may be determined in operation 57 by dividing the amount of withdrawn analysis gas by the measured amount of analysis gas introduced to the drilling fluid sample.

Once the extraction efficiency of the analysis gas has been determined in operation 57, the extraction efficiency may then be correlated to a concentration of a wellbore gas present in the drilling fluid in operation 58. The wellbore gas being analyzed may be present in the same sample of drilling fluid to which the analysis gas was added. That is, both the analysis gas and the wellbore gas may be analyzed at the detector at the same time or in sequence with one another. In other cases, the extraction efficiency of the analysis gas may be determined for a first sample of the drilling fluid and the extraction efficiency of the analysis gas may then be used to determine the concentration of a wellbore gas in a second sample of the drilling fluid under like degassing conditions.

Finally, in operation 59, the concentration of a wellbore gas in the drilling fluid may be correlated to a property of the subterranean formation. For example, one may determine if a drilling operation has reached a desired subterranean zone based upon the content of the drilling fluid withdrawn from the wellbore. One of ordinary skill in the art will recognize parameters that may be inferred regarding a subterranean formation or a drilling operation based upon the content of the drilling fluid withdrawn from a wellbore.

As mentioned above, the methods of the present disclosure may be coupled to a drilling process. Illustrative disclosure regarding suitable drilling processes to which the present analyses may be coupled follows herein below.

Figure 3:
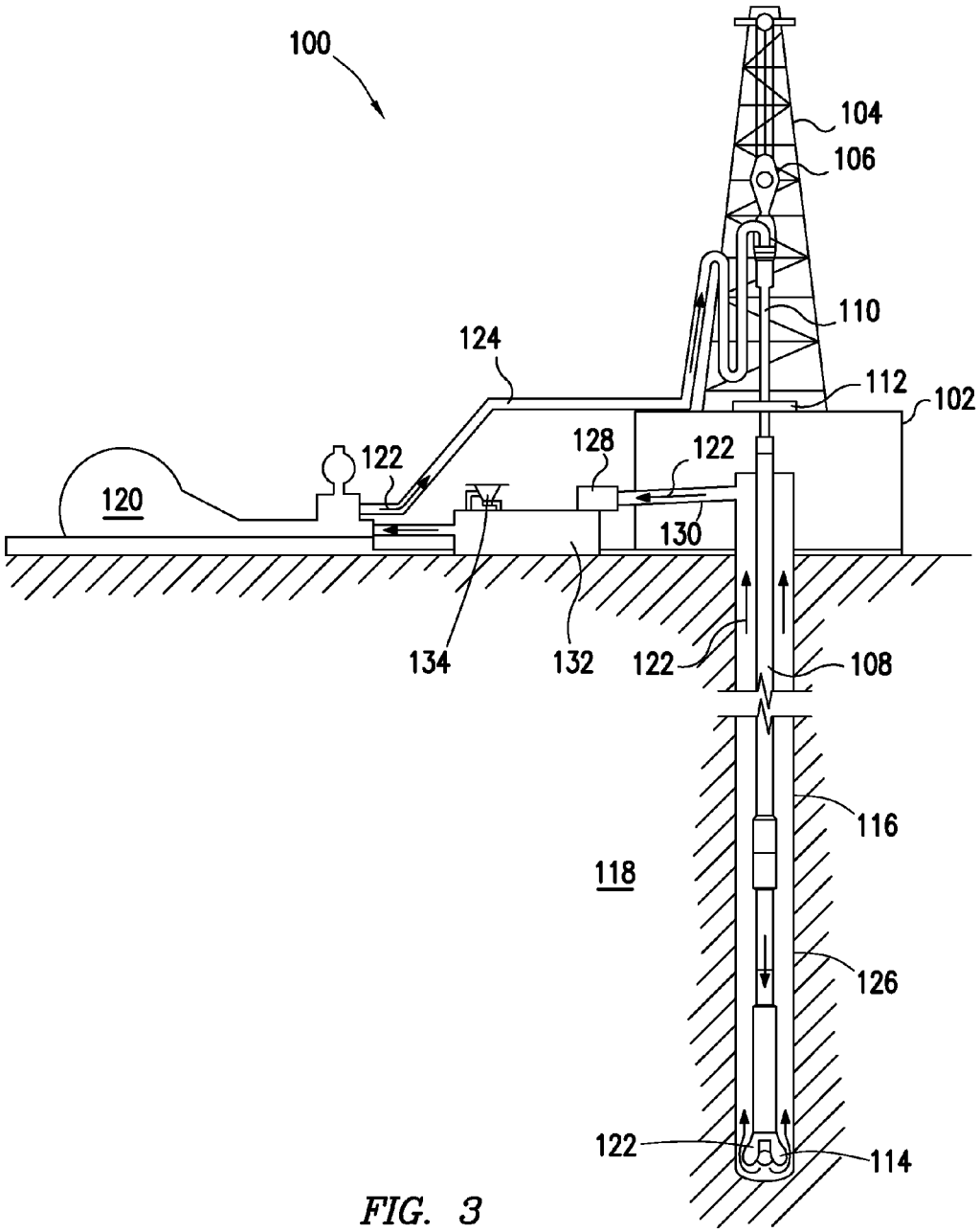
FIG. 3 shows a schematic of an illustrative drilling assembly.

FIG. 3 shows an illustrative schematic of a drilling assembly. While FIG. 3 generally depicts a land-based drilling assembly, one having ordinary skill in the art will readily recognize that the principles described herein are equally applicable to subsea drilling operations that employ floating or sea-based platforms and rigs, without departing from the scope of the disclosure.

As illustrated, drilling assembly 100 may include drilling platform 102 that supports derrick 104 having traveling block 106 for raising and lowering drill string 108. Drill string 108 may include, but is not limited to, drill pipe and coiled tubing, as generally known by one having ordinary skill in the art. Kelly 110 supports drill string 108 as it is lowered through rotary table 112. Drill bit 114 is attached to the distal end of drill string 108 and is driven either by a downhole motor and/or via rotation of drill string 108 from the well surface. As drill bit 114 rotates, it creates borehole 116 that penetrates various subterranean formations 118.

Pump 120 (e.g., a mud pump) circulates drilling fluid 122 through feed pipe 124 and to kelly 110, which conveys drilling fluid 122 downhole through the interior of drill string 108 and through one or more orifices in drill bit 114. Drilling fluid 122 is then circulated back to the surface via annulus 126 defined between drill string 108 and the walls of borehole 116. At the surface, the recirculated or spent drilling fluid 122 exits annulus 126 and may be conveyed to one or more fluid processing unit(s) 128 via interconnecting flow line 130. After passing through fluid processing unit(s) 128, a "cleaned" drilling fluid 122 is deposited into nearby retention pit 132 (i.e., a mud pit). While illustrated as being arranged at the outlet of wellbore 116 via annulus 126, one having ordinary skill in the art will readily appreciate that fluid processing unit(s) 128 may be arranged at any other location in drilling assembly 100 to facilitate its proper function, without departing from the scope of the disclosure.

Drilling fluid 122 may be formulated in mixing hopper 134 that is communicably coupled to or otherwise in fluid communication with retention pit 132. Mixing hopper 134 may include, but is not limited to, mixers and related mixing equipment known to a person having ordinary skill in the art. In at least one embodiment, for example, there could be more than one retention pit 132, such as multiple retention pits 132 in series. Moreover, retention pit 132 may be representative of one or more fluid storage facilities and/or units where drilling fluid 122 may be stored, reconditioned, and/or regulated.

Drilling fluid 122 may directly or indirectly affect the components and equipment of drilling assembly 100. For example, drilling fluid 122 may directly or indirectly affect fluid processing unit(s) 128 which may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and any fluid reclamation equipment. Fluid processing unit (s) 128 may further include one or more sensors, gauges, pumps, compressors, and the like used to store, monitor, regulate, and/or recondition the exemplary drilling fluids.

Drilling fluid 122 may directly or indirectly affect pump 120, which representatively includes any conduits, pipelines, trucks, tubulars, and/or pipes used to fluidically convey the drilling fluids downhole, any pumps, compressors, or motors (e.g., topside or downhole) used to drive the drilling fluids into motion, any valves or related joints used to regulate the pressure or flow rate of the drilling fluids, and any sensors (i.e., pressure, temperature, flow rate, etc.), gauges, and/or combinations thereof, and the like. Drilling fluid 122 may also directly or indirectly affect mixing hopper 134 and retention pit 132 and their assorted variations.

Drilling fluid 122 may also directly or indirectly affect the various downhole equipment and tools that may come into contact with the drilling fluids such as, but not limited to, drill string 108, any floats, drill collars, mud motors, downhole motors and/or pumps associated with drill string 108, and any MWD/LWD tools and related telemetry equipment, sensors or distributed sensors associated with drill string 108. Drilling fluid 122 may also directly or indirectly affect any downhole heat exchangers, valves and corresponding actuation devices, tool seals, packers and other wellbore isolation devices or components, and the like associated with wellbore 116. Drilling fluid 122 may also directly or indirectly affect drill bit 114, which may include, but is not limited to, roller cone bits, PDC bits, natural diamond bits, any hole openers, reamers, coring bits, and the like.

While not specifically illustrated herein, drilling fluid 122 may also directly or indirectly affect any transport or delivery equipment used to convey the drilling fluids to drilling assembly 100 such as, for example, any transport vessels, conduits, pipelines, trucks, tubulars, and/or pipes used to fluidically move the drilling fluids from one location to another, any pumps, compressors, or motors used to drive the drilling fluids into motion, any valves or related joints used to regulate the pressure or flow rate of the drilling fluids, and any sensors (i.e., pressure and temperature), gauges, and/or combinations thereof, and the like.

Embodiments disclosed herein include:

A. Methods for assaying a drilling fluid. The methods comprise: combining a measured amount of an analysis gas with a drilling fluid sample; transferring the drilling fluid sample and the analysis gas contained therein to a degassing unit; withdrawing at least a portion of the analysis gas from the drilling fluid sample in the degassing unit; conveying the withdrawn analysis gas from the degassing unit to a detector, the withdrawn analysis gas being conveyed with an inert carrier gas; determining an amount of the withdrawn analysis gas with the detector; and calculating an extraction efficiency of the analysis gas from the drilling fluid sample based upon the amount of the withdrawn analysis gas.

B. Methods for assaying a drilling fluid. The methods comprise: obtaining a drilling fluid sample from a wellbore; combining a measured amount of an analysis gas with the drilling fluid sample; transferring the drilling fluid sample and the analysis gas contained therein to a degassing unit; withdrawing at least a portion of the analysis gas from the drilling fluid sample in the degassing unit; conveying the withdrawn analysis gas from the degassing unit to a detector, the withdrawn analysis gas being conveyed with an inert carrier gas; determining a concentration of the analysis gas with the detector; determining an amount of the inert carrier gas used to convey the withdrawn analysis gas to the detector; determining an amount of the withdrawn analysis gas based upon the amount of the inert carrier gas and the concentration of the analysis gas measured at the detector; calculating an extraction efficiency of the analysis gas from the drilling fluid sample based upon the amount of the withdrawn analysis gas; and correlating the extraction efficiency of the analysis gas to a concentration of a wellbore gas in the drilling fluid.

Each of embodiments A and B may have one or more of the following additional elements in any combination:

Element 1: wherein the method further comprises: determining an amount of the inert carrier gas used to convey the withdrawn analysis gas to the detector; and determining the amount of the withdrawn analysis gas based upon the amount of the inert carrier gas and a concentration of the analysis gas measured at the detector.

Element 2: wherein the method further comprises: drilling a wellbore with a drilling fluid; obtaining the drilling fluid sample from the wellbore; analyzing a quantity of drilling fluid exiting the wellbore for a wellbore gas; and correlating the extraction efficiency of the analysis gas to a concentration of the wellbore gas in the drilling fluid exiting the wellbore.

Element 3: wherein the method further comprises: measuring the pressure and volume of the analysis gas introduced to the drilling fluid sample to determine the measured amount of the analysis gas.

Element 4: wherein the method further comprises: obtaining the drilling fluid sample from a wellbore before combining the analysis gas therewith.

Element 5: wherein the analysis gas is not natively present in the wellbore.

Element 6: wherein the analysis gas comprises acetylene.

Element 7: wherein the detector comprises a flame ionization detector.

Element 8: wherein the analysis gas is withdrawn from the drilling fluid sample at a sub-atmospheric pressure.

By way of non-limiting example, exemplary combinations applicable to A and B include:

The method of A in combination with elements 1 and 2.
The method of A in combination with elements 1 and 3.
The method of A in combination with elements 2 and 3.
The method of A in combination with elements 1 and 4.
The method of A in combination with elements 2 and 4.
The method of A in combination with elements 4 and 5.
The method of A in combination with elements 4 and 6.
The method of A in combination with elements 6 and 7.
The method of A in combination with elements 1, 2 and 3.
The method of A in combination with elements 1, 2 and 4.
The method of B in combination with elements 3 and 5.
The method of B in combination with elements 3 and 6.
The method of B in combination with elements 3 and 7.
The method of B in combination with elements 3 and 8.
The method of B in combination with elements 5 and 6.
The method of B in combination with elements 5 and 7.
The method of B in combination with elements 6 and 7.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The disclosure illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:
combining a measured amount of an analysis gas with a drilling fluid sample;
transferring the drilling fluid sample and the analysis gas contained therein to a degassing unit;
withdrawing at least a portion of the analysis gas from the drilling fluid sample in the degassing unit;
conveying the withdrawn analysis gas from the degassing unit to a detector, the withdrawn analysis gas being conveyed with an inert carrier gas;
determining an amount of the withdrawn analysis gas with the detector; and
calculating an extraction efficiency of the analysis gas from the drilling fluid sample based upon the amount of the withdrawn analysis gas.

2. The method of claim 1, further comprising:
determining an amount of the inert carrier gas used to convey the withdrawn analysis gas to the detector; and
determining the amount of the withdrawn analysis gas based upon the amount of the inert carrier gas and a concentration of the analysis gas measured at the detector.

3. The method of claim 1, further comprising:
drilling a wellbore with a drilling fluid;
obtaining the drilling fluid sample from the wellbore;
analyzing a quantity of drilling fluid exiting the wellbore for a wellbore gas; and
correlating the extraction efficiency of the analysis gas to a concentration of the wellbore gas in the drilling fluid exiting the wellbore.

4. The method of claim 1, further comprising:
measuring the pressure and volume of the analysis gas introduced to the drilling fluid sample to determine the measured amount of the analysis gas.

5. The method of claim 1, further comprising:
obtaining the drilling fluid sample from a wellbore before combining the analysis gas therewith.

6. The method of claim 5, wherein the analysis gas is not natively present in the wellbore.

7. The method of claim 6, wherein the analysis gas comprises acetylene.

8. The method of claim 1, wherein the detector comprises a flame ionization detector.

9. The method of claim 1, wherein the analysis gas is withdrawn from the drilling fluid sample at a sub-atmospheric pressure.

10. A method comprising:
obtaining a drilling fluid sample from a wellbore;
combining a measured amount of an analysis gas with the drilling fluid sample;

transferring the drilling fluid sample and the analysis gas contained therein to a degassing unit;

withdrawing at least a portion of the analysis gas from the drilling fluid sample in the degassing unit, the analysis gas being withdrawn from the drilling fluid sample at a sub-atmospheric pressure;

conveying the withdrawn analysis gas from the degassing unit to a detector, the withdrawn analysis gas being conveyed with an inert carrier gas;

determining a concentration of the analysis gas with the detector;

determining an amount of the inert carrier gas used to convey the withdrawn analysis gas to the detector;

determining an amount of the withdrawn analysis gas based upon the amount of the inert carrier gas and the concentration of the analysis gas measured at the detector;

calculating an extraction efficiency of the analysis gas from the drilling fluid sample based upon the amount of the withdrawn analysis gas; and correlating the extraction efficiency of the analysis gas to a concentration of a wellbore gas in the drilling fluid.

11. The method of claim 10, further comprising:

measuring the pressure and volume of the analysis gas introduced to the drilling fluid sample to determine the measured amount of the analysis gas.

12. The method of claim 10, wherein the analysis gas is not natively present in the wellbore.

13. The method of claim 12, wherein the analysis gas comprises acetylene.

14. The method of claim 10, wherein the detector comprises a flame ionization detector.

15. The method of claim 10, wherein the analysis gas is withdrawn from the drilling fluid sample at a sub-atmospheric pressure.

* * * * *